United States Patent [19]

Laauwe

[11] 4,091,966

[45] May 30, 1978

[54] SQUEEZE BOTTLE CONTAINING A POWDERED PRODUCT AND OPERATIVE WHETHER UPRIGHT OR INVERTED

[76] Inventor: Robert H. Laauwe, 237 Green Ridge Rd., Franklin Lakes, N.J. 07417

[21] Appl. No.: 691,710

[22] Filed: June 1, 1976

[51] Int. Cl.[2] ..... B65D 37/00

[52] U.S. Cl. ..... 222/211

[58] Field of Search ..... 222/207, 211, 209, 457, 222/402.11, 402.18, 402.19, 500, 376, 464; 137/43

[56] References Cited

U.S. PATENT DOCUMENTS

| | | | |
|---|---|---|---|
| 2,358,329 | 9/1944 | Houghton | 222/193 |
| 2,450,205 | 9/1948 | Rose | 222/193 |
| 2,981,444 | 4/1961 | Root | 222/211 X |
| 3,069,098 | 12/1962 | Frangos et al. | 222/402.19 X |
| 3,499,583 | 3/1970 | Hauer et al. | 222/211 |
| 3,545,488 | 12/1970 | Venus, Jr. | 222/402.19 UX |

*Primary Examiner*—Joseph F. Peters, Jr.
*Assistant Examiner*—Norman L. Stack, Jr.
*Attorney, Agent, or Firm*—Kenyon & Kenyon, Reilly, Carr & Chapin

[57] ABSTRACT

A squeeze bottle containing a powdered product such as conventional talcum powder and the like, has a construction such that when the bottle is upright and the powdered product is compacted in the bottom, a carrier stream of air is introduced to the product when the bottle is squeezed, to break up the compacted product for discharge through a dispensing orifice with which the bottle is provided. When the bottle is inverted, the construction is such that again a carrier stream of air, when the bottle is squeezed, is discharged through a fed stream of the product for dispensing by the squeeze bottle.

1 Claim, 6 Drawing Figures

SQUEEZE BOTTLE CONTAINING A POWDERED PRODUCT AND OPERATIVE WHETHER UPRIGHT OR INVERTED

BACKGROUND OF THE INVENTION

Squeeze bottles have been widely used for many products. When used for powdered products of a particle size typically represented by conventional talcum powder, such a package has not been satisfactory in the past.

The problem has been that the package must have a dip tube dipping into the powdered product so that when the bottle is squeezed, the product can be dispensed through the nozzle of the bottle. When the bottle stands stationary, as on the merchandising shelf or in the home, the powder compacts about the entrance to the dip tube, this alone blocking the entrance to the dip tube and being compounded by the fact that most powdered products are hygroscopic, pick up moisture, and acquire the characteristics of a solidized mass. When the bottle is squeezed there is no dispensing of the product under such circumstances.

For upright operation, a squeeze bottle containing powder must have the dip tube for ejection of the product when the bottle is squeezed. If it were not for the compaction and blockage problem, such a squeeze bottle might operate successfully when upright. However, if the squeeze bottle is inverted for actuation, the dip tube then opens into an air space formed within the squeeze bottle in the absence of literally complete filling of the bottle. The object of the present invention is to provide a squeeze bottle containing a powdered product and which can be operated successfully either upright and after standing upright for a time, or operated with equal success when inverted, as well as in all angularities between upright and inverted positions.

SUMMARY OF THE INVENTION

To achieve the above object, a squeeze bottle, which may be of conventional construction and containing any of the normally dispensed powdered products, typically represented by talcum powder, has the usual air space which is normally above the product when the squeeze bottle is upright. This air space is normally required for the proper operation of any squeeze bottle containing a powdered product.

The bottle has what may be the usual mouth closed by a nozzle having an axial dispensing passage. With prior art constructions, the inner end of this passage would be provided with a dip tube if the bottle is intended for upright operation, or the dip tube would be dispensed with if the bottle was intended for operation when inverted.

However, with the present invention, means are provided for forming a U-tube having one of its upper ends connected with the inside end of the passage through the nozzle. The tube's U-bend is positioned adjacent to the bottle's bottom and its other upper end opens into the air space in the bottle when the bottle is upright. The means referred to also provides for an orifice in the U-bend of the U-tube, and this orifice is open to the powdered product in the bottle when the bottle is upright.

Finally, the nozzle has an orifice extending transversely from its axially extending dispensing passage and opening into the air space in the bottle when the bottle is upright.

An important feature is that the above orifice which extends transversely from the nozzle's axial passage and opens into the air space when the bottle is upright, should have a smaller flow-rate capacity than that of either the orifice in the U-bend of the U-tube, and which is adjacent to the bottle's bottom, or in the open upper end of the U-tube which opens into the air space when the bottle is upright.

With the above construction, when the bottle is upright and squeezed, the air in the air space is compressed as part of the entire contents of the bottle, this air entering the open upper end of the U-tube, traveling downwardly to the U-bend where, via the orifice at that location, the powdered product has gravitationally fed into the bottom of the U-tube previously, this air, pressurized by squeezing of the bottle, being injected into the powdered mass and breaking it up in the event it has been compacted by long standing of the bottle when upright. Being thus broken apart from its possibly compacted condition, the air stream then carries the powdered product up the leg of the U-tube connecting with the dispensing passage of the nozzle. It is possible that the powdered product is in the form of a solid and undispersed flow when it reaches the nozzle, but at that location the orifice that opens transversely from the air space into the dispensing passage, provides a jet of atomizing or dispensing air into the discharging powdered product with the result that it discharges from the nozzle in spray or dispersed form.

Because the orifice that opens transversely into the passage in the nozzle, for atomizing or dispersing of the discharged or powdered product, is of smaller flow-rate capacity than the other two openings, air discharged from the bottle by squeezing, is capable of flowing at a greater rate and fully effective rate through the open end of the U-tube leg that connects directly with the air space.

When the bottle is inverted for squeezing, the powdered product is forced to enter the U-tube's upper end that would otherwise open into the air space if the bottle were upright. The product is forced to the bottom or U-bend of the U-tube where the orifice at that point now opens into the air space formed by inversion of the bottle, this providing an aspirating or atomizing or air-carrying effect for the product which then drives downwardly through the leg of the U-tube connected with the nozzle. At the nozzle some of the powdered product will feed through the transverse orifice into the discharging stream of air and powdered product, but the amount of carrier air is adequate to result in a spray-type discharge of powdered product.

From the foregoing it can be seen that the new squeeze bottle of powdered product made in accordance with the present invention, can be operated successfully in an upright condition even after long storage while upright. Also, it can be successfully operated when inverted and squeezed. It naturally follows that with all angularities of operation between truly vertical upright and inverted positions, successful operation is assured.

BRIEF DESCRIPTION OF THE DRAWINGS

A specific example of the present invention is illustrated by the accompanying drawings, in which:

FIG. 2 is like FIG. 5 but shows the operation in the case of a downward angularity of the new bottle.

DETAILED DESCRIPTION OF THE INVENTION

Figure 4:
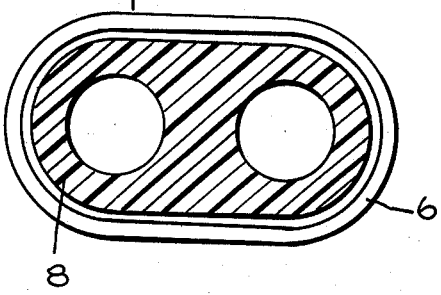
FIG. 4 is a cross section taken on the line IV—IV in FIG. 2.
Figure 1:
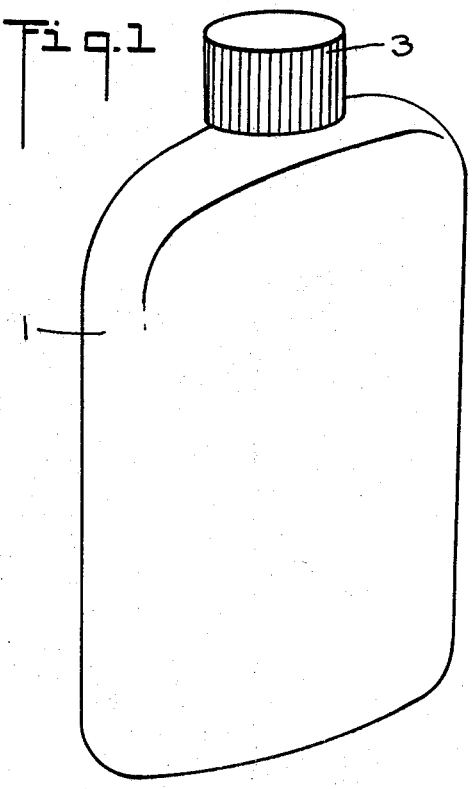
FIG. 1 is a perspective view showing the new squeeze bottle.
Figure 2:
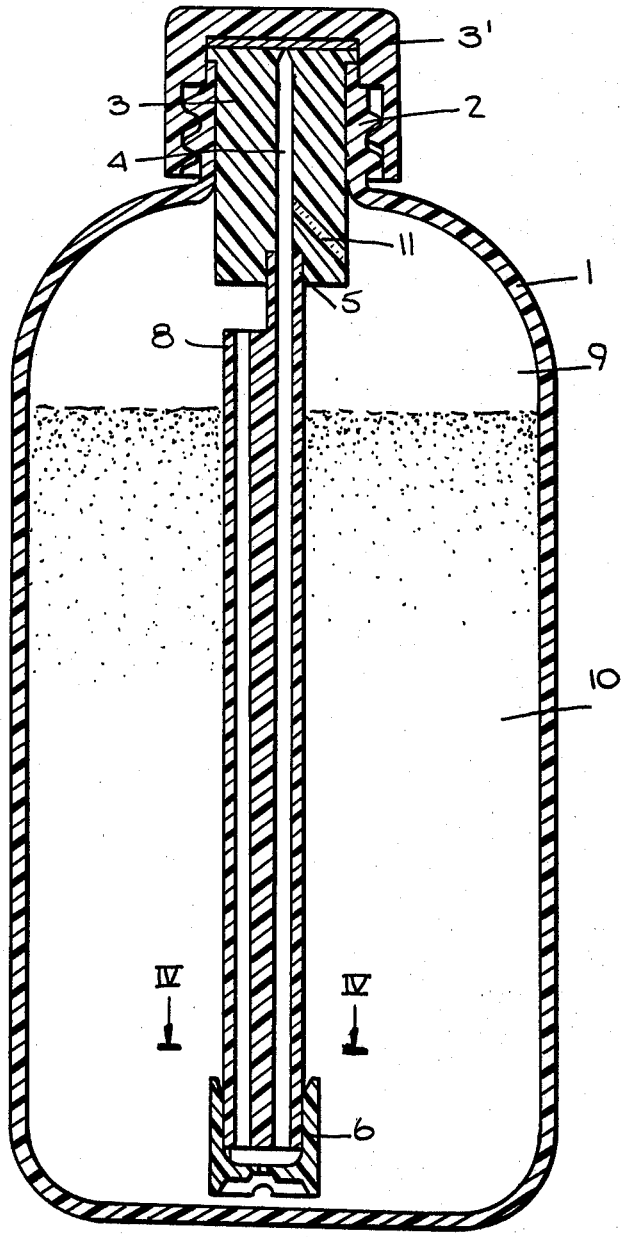
FIG. 2 is a vertical section of the new bottle.

Having reference to the above drawings, the bottle 1 may be made of any of the flexible plastics commonly used for squeeze bottles. It has a mouth 2 which may be closed by a screw cap 3 either for shipment or, if desirable, to provide a cap which can be constructed in a so-called child-proof manner.

The mouth 2 is closed by a nozzle 3 which may also be made of plastic and press-fitted into the mouth. This nozzle has an axially extending dispensing passage 4.

The means for providing the U-tube previously referred to, may be provided in various ways. It could, for example, simply comprise a doubled-up version of the usual plastic tubing conventionally used to make dip tubes in the case of prior art packages. It could be two separate tubes of such material with a connection fitting at the bottom.

Figure 3:
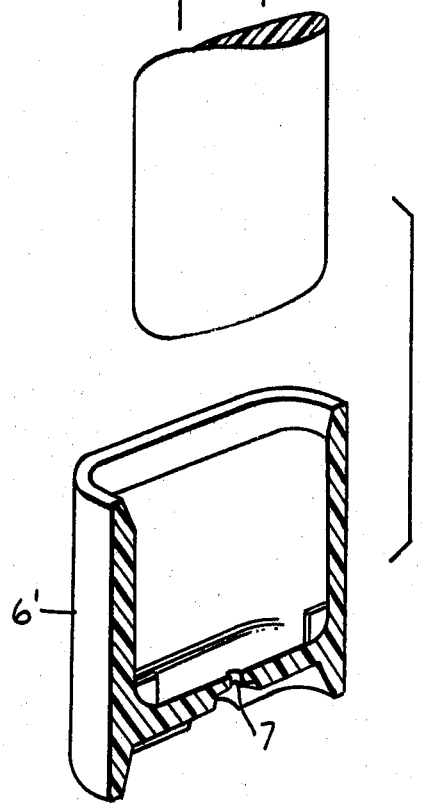
FIG. 3 is an exploded view showing a specific example of a U-bend for a specific type of U-tube construction.

However, the drawings show what is considered at this time to be preferable, namely, a plastic extrusion in the form of twin or double tube, this providing the U-tube of which one upper end 5 is connected with the inner end of the passage 4, the U-bend being shown at 6 as comprising a cap or fitting of generally cup-like construction shown at 6' in FIG. 3, the bottom of this cup-like fitting having the orifice 7 previously referred to. The end of the U-tube other than the end 5 is shown at 8 as opening into the air space 9 inherently formed above the powdered product 10 in the bottle when the bottle is upright.

The transverse orifice provided for the nozzle is shown at 11, this extending diagonally between the passage 4 and the space 9.

Figure 5:
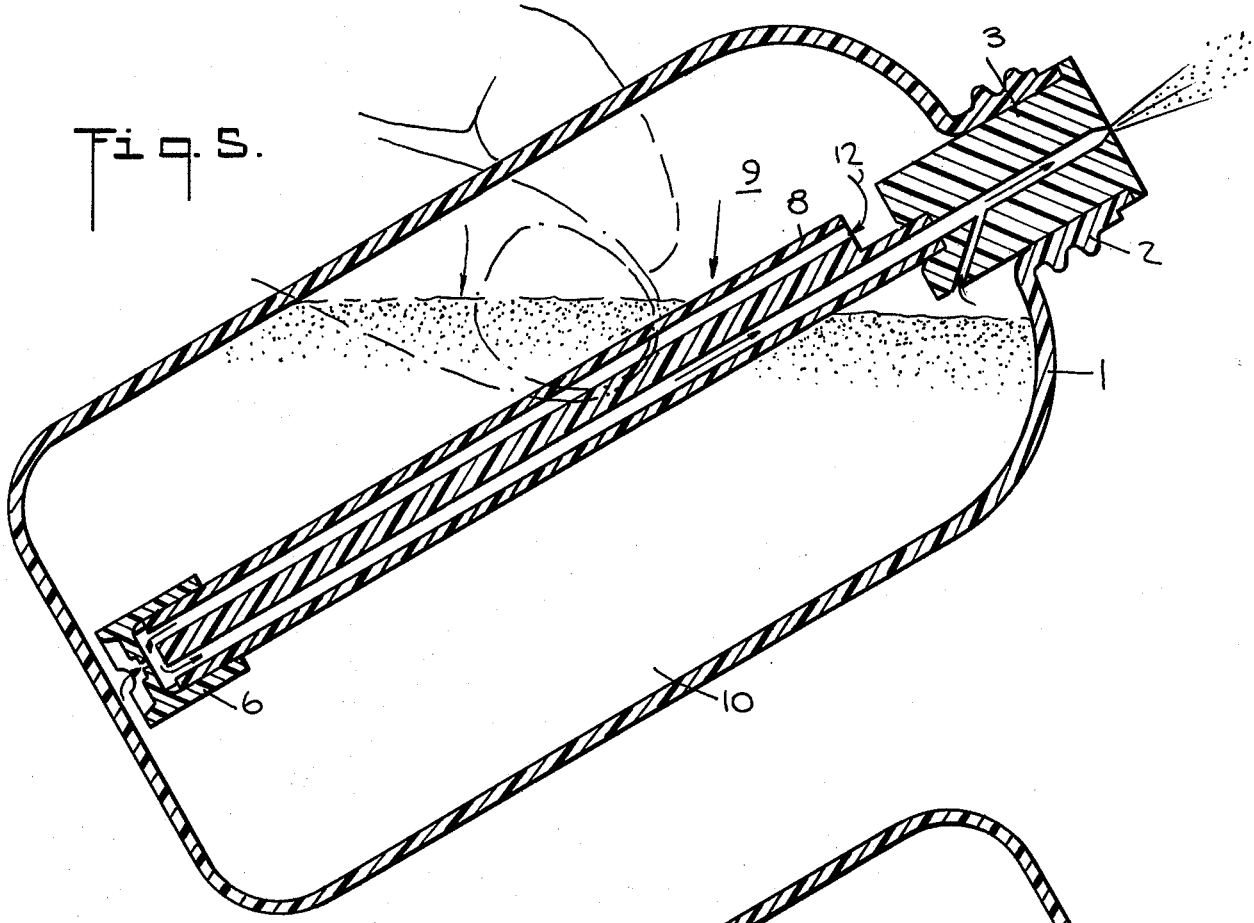
FIG. 5 is similar to FIG. 2 but shows the operation of the new squeeze bottle when squeezed with the bottle in a diagonally upwardly pointed condition.

Throughout the foregoing, it is to be understood that it is clear when the bottle is upright that the air space 9 is formed above the product. However, it is storage in this upright position that has presented the squeeze-bottle industry with the problem of compaction and the resulting inoperativeness of prior art squeeze bottles. With the present invention, as is shown by FIG. 5, squeezing of the squeeze bottle causes the air in the air space 9 to enter the open upper end of the U-tube as indicated by the arrow 12 in FIG. 5, the product itself, normally through gravitational flow, filling both legs of the U-tube at its bottom, and with long upright standing, the product may be compacted in that area to which it has naturally flowed via the orifice 7. The pressurized air descending through the one leg of the U-tube, picks up any such compacted powdered product and carries it upwardly through the leg of the U-tube that connects with the dispensing passage 4, where, while flowing through this passage, pressurized air, resulting from squeezing of the bottle, ejects angularly into the flow via the orifice 11 so as to provide an atomizing effect. Ths orifice 11 must be made with a small enough flow capacity, as by adjustment of the hole diameter, so that all of the air in the air space 9 will not eject uselessly through this orifice. The majority of the air should be forced down through the U-tube and around its U-bend and upwardly for dispensing.

Figure 6:
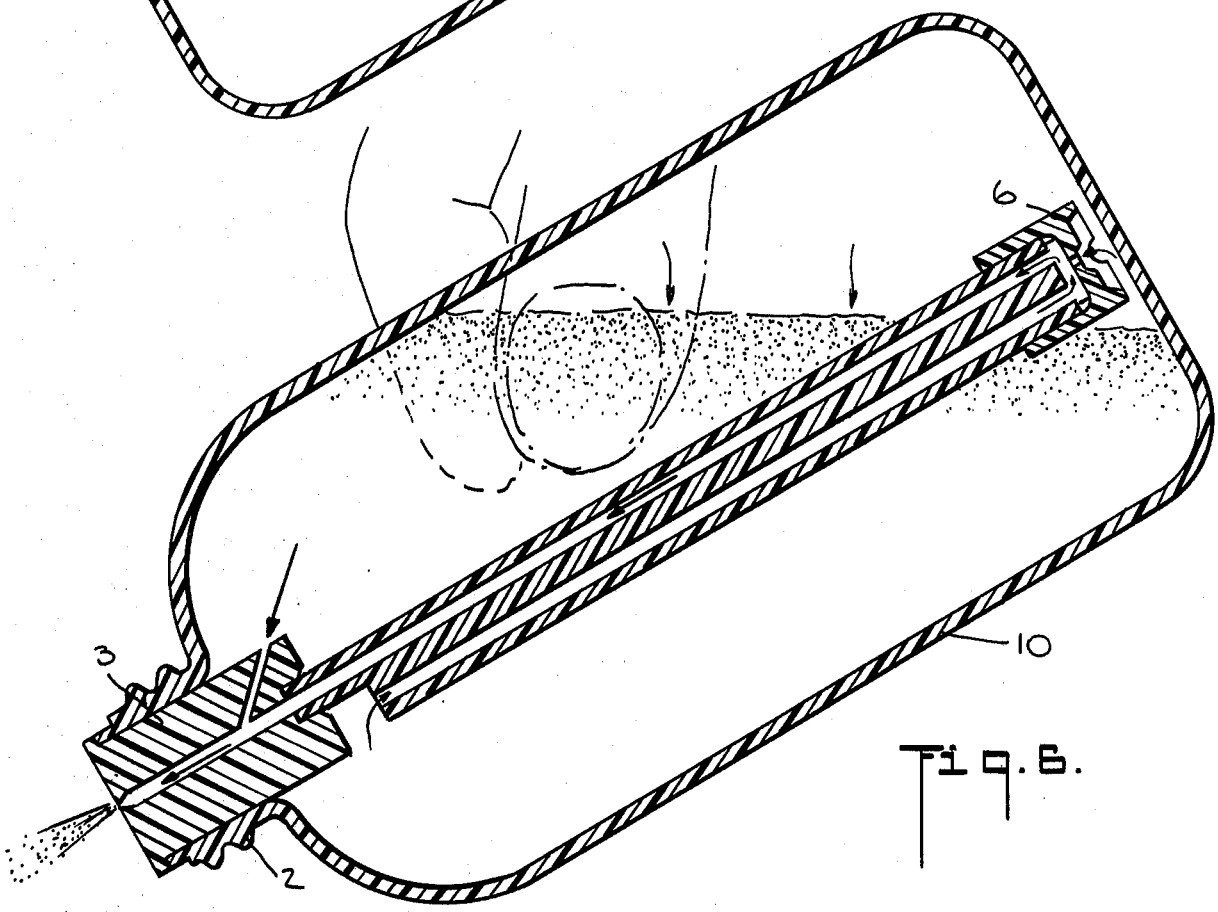

When inverted and squeezed, as shown by FIG. 6, the powdered product is forced largely through the open end 8 of the U-tube and upwardly and around and reversely or downwardly to the dispensing passage of the nozzle, the pressurized air entering the orifice 7 at the U-tube bend and forming a carrier gas for the product so that it is again ejected as a spray even though the bottle is operated downwardly or upside down. Some of the powdered product may flow through the orifice 11 of the smaller flow capacity, but it enters a fluidized stream of powdered product, fluidized by the air pressed through he orifice 7 of the U-bend of the tube arrangement.

The particular U-tube illustrated may be a plastic extrusion of double tubing, the plastic bottom fitting shown by FIG. 3 serving to provide the U-bend with its necessary orifice.

It can be seen that with this new package there are three openings or orifices that must be considered. The orifice 11 must always be of the smaller size because its main function is to provide for atomization without excessive loss of the air required to function as a product propellant. The size of the orifices 7 and 8, the latter being the open end of the U-tube, may require adjustment by experimentation. An exact description of the size relationship of these orifices cannot be given because they depend to some extent on the exact particle size, density, flow characteristics, etc., of the particular powdered product with which the bottle is loaded.

What is claimed is:

1. A squeeze bottle package adapted for operation either upright or inverted and containing a powdered product and an air space; said bottle having a mouth closed by a nozzle having a dispensing passage; means for forming a U-tube having one upper end connected with said passage, a U-bend adjacent to the bottle's bottom, its other upper end opening into said air space when the bottle is upright, and an orifice in the bottom of the U-bend and open to the product when the bottle is upright; said nozzle having an orifice extending transversely from its said passage and opening into said air space when the bottle is upright and having a smaller flow-rate capacity than that of either the first-named orifice or said open upper end, inversion of the bottle causing the U-tube's said other open end and the second-named orifice to open to the product and the first-named orifice to open to the air space then formed above the product.

* * * * *